US006188358B1

(12) United States Patent
Clynne

(10) Patent No.: US 6,188,358 B1
(45) Date of Patent: Feb. 13, 2001

(54) ANTENNA SIGNAL CONDUIT FOR DIFFERENT TEMPERATURE AND PRESSURE ENVIRONMENTS

(75) Inventor: Thomas H. Clynne, Oriskany, NY (US)

(73) Assignee: Infrared Components Corporation, Utica, NY (US)

( * ) Notice: Under 35 U.S.C. 154(b), the term of this patent shall be extended for 0 days.

(21) Appl. No.: 08/954,649

(22) Filed: Oct. 20, 1997

(51) Int. Cl.[7] ..... H01Q 1/12; H01P 1/04

(52) U.S. Cl. ..... 343/700 R; 343/895; 333/99 R; 333/246; 333/260; 62/51.1

(58) Field of Search ..... 333/99 R, 260, 333/246; 343/700 R, 895, 850; 174/15.4; 505/163, 883, 888, 400; 62/51.1

(56) References Cited

U.S. PATENT DOCUMENTS

H653 * 7/1989 Conrad ..... 505/866
3,389,352 * 6/1968 Kliphuis ..... 333/99 R
4,498,046 * 2/1985 Faris et al. .
4,528,530 * 7/1985 Ketchen ..... 333/260 X
4,739,633 * 4/1988 Faris et al. .
4,809,133 * 2/1989 Faris et al. .
4,980,754 * 12/1990 Kotani et al. .
5,913,888 * 6/1999 Steinmeyer et al. ..... 62/51.1

* cited by examiner

*Primary Examiner*—Benny Lee
(74) *Attorney, Agent, or Firm*—August E. Roehrig, Jr.; Hancock & Estabrook, LLP

(57) ABSTRACT

A frequency matched signal conduit apparatus wherein a micro-strip feed fabricated onto a material consistent with long vacuum life applications, such as ceramic or other crystalline materials, is used with a vacuum vessel signal interconnect, electrically connected to the micro-strip feed, comprising thermally resistive, electrically conductive material that provides high thermal isolation and low signal loss, for electrically connecting the micro-strip feed network to a device to be cooled.

14 Claims, 5 Drawing Sheets

FIG. 2
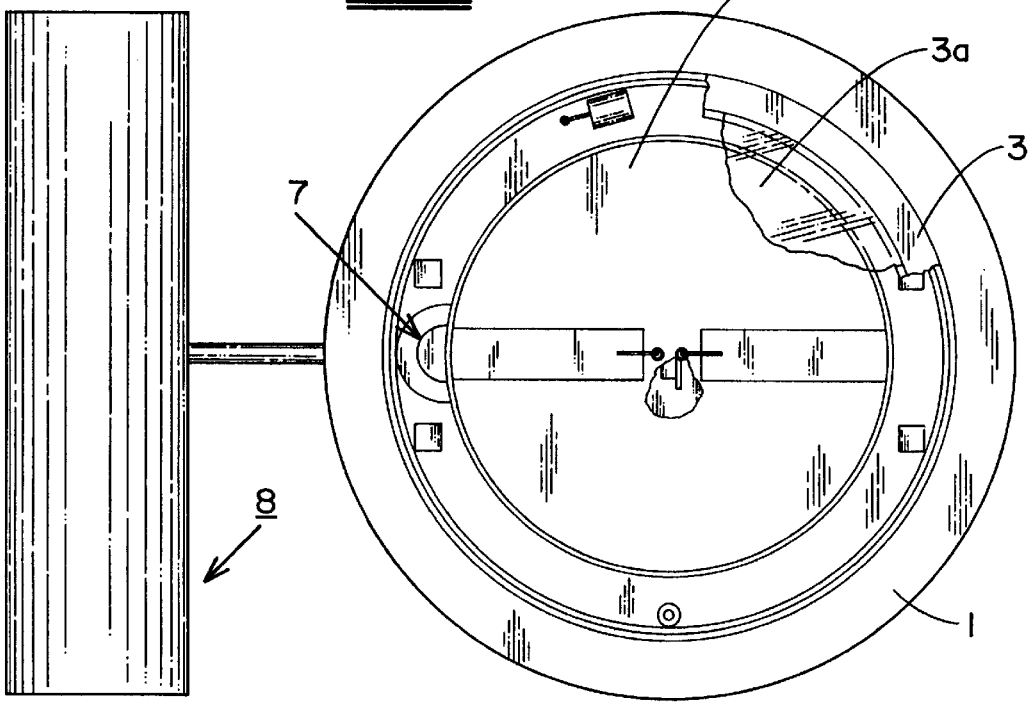
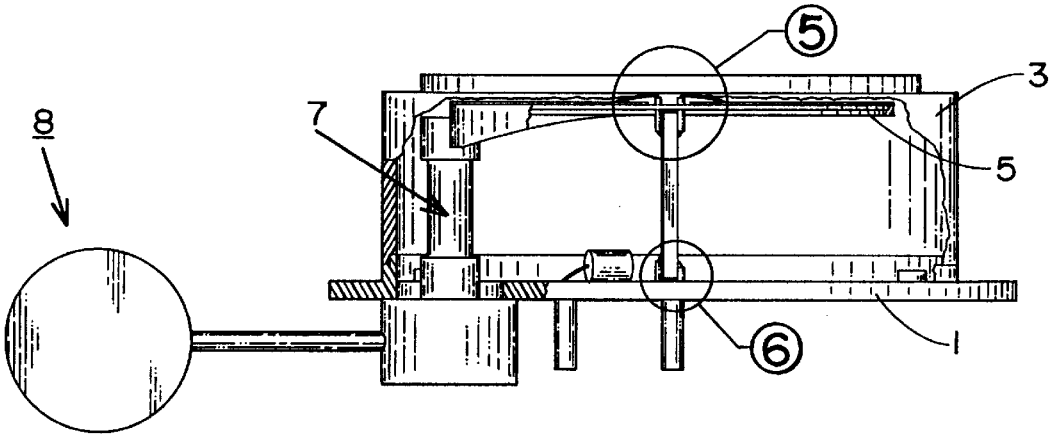
FIG. 3

ANTENNA SIGNAL CONDUIT FOR DIFFERENT TEMPERATURE AND PRESSURE ENVIRONMENTS

FIELD OF TECHNOLOGY

This application relates in general to a signal conduit apparatus, and, more specifically, to a signal conduit apparatus for carrying an electrical signal from a device kept at a first temperature to an area having a second temperature with a minimal amount of heat transfer. In a preferred embodiment the device is also kept in a vacuum, or partial vacuum, and the signal is carried to an area having a higher pressure.

BACKGROUND AND SUMMARY

Many devices are designed and intended to be used in an environment of very low, or even cryogenic temperatures, where they produce an electrical signal which must be carried into an area of higher temperature before the signal is utilized, tested, or transmitted. Quite often the lower temperature device is contained in a vacuum dewar vessel to achieve a high degree of thermal isolation, in order to eliminate the convective heat transfer loss that would otherwise occur. In using such a device, several challenges need to be overcome in constructing a signal conduit apparatus for carrying the signal from the cold device in the dewar to the warmer, "outside world" area. These challenges include preserving the integrity of the vacuum within the dewar, reducing the conductive heat transfer loss such as keeping heat from passing through the signal conduit to the device, and keeping signal loss to a minimum.

Prior art apparatus used for carrying such signals have encountered problems in meeting these challenges. Prior art low-signal-loss RF interconnection techniques typically rely upon traditional type coaxial cable. Such coaxial cables do provide low signal loss and maintain relatively good signal integrity, but are made of materials that cannot be successfully used in applications that require low out-gassing and long life, such as encountered in a long term vacuum environment. This is because the presence of organic dielectric materials and entrapped gasses within the coaxial cable structure leads to virtual leaks within the vacuum vessel. Such leaks introduce gases into the vacuum environment that are not readily absorbable via traditional gettering techniques, and thereby preclude the successful use of coaxial cable in long-life vacuum applications. Additionally, the presence of entrapped gasses caused by the basic structure of metal cladding or braiding over the dielectric materials, can cause vacuum failure leading to system level failures.

Coaxial cables also incur high thermal conduction losses that contribute unacceptable levels of parasitic heat loss to a system. Coaxial cable and other prior art apparatus are also generally bulky, and are often complex due to the increased number of parts needed to complete the apparatus and connect the signal conduit between the device and the "outside world." For example, coaxial cables require that there be some sort of interconnect hardware at each end, involving threaded connector backshells and housings that are an additional source of entrapped gas, and can cause vacuum failure over the life of the product as the gas is released.

Another approach is the utilization of bulk materials to provide thermal isolation and interconnection. This is primarily the method described in U.S. Pat. No. 4,739,633 ("Room Temperature to Cryogenic Electrical Interface") and U.S. Pat. No. 4,498,046 ("Room Temperature Cryogenic Test Interface"). The disadvantages of the approach described and taught by these patents include structural and fragility limitations involved with the handling of brittle interconnection material, and the rather substantial parasitic heat load occasioned by allowing the same material used to support the circuit to be cooled, to have an interface at room temperature. Additionally, it is difficult, if not impossible, to create an adequate hermetic seal around the area where the apparatus and its interconnection penetrate the dewar vessel.

Successful vacuum packaging requires that any materials used in the construction that are exposed to the vacuum must be sufficiently leak-tight, and have low outgassing properties so as not to cause an internal gas pressure in excess of approximately $10^{-4}$ Torr to develop over the desired lifetime of the product.

In order to minimize the cooling capacity requirement, physical size, and the total power consumption of the unit, the method of constructing the apparatus for interconnecting and physically supporting the device should maximize its thermal impedance. Accordingly, the present invention provides a frequency matched signal conduit apparatus comprising a micro-strip feed fabricated onto a material consistent with long vacuum life applications, such as ceramic or other crystalline materials, a vacuum vessel signal penetration member electrically connected to the micro-strip feed, and, in the preferred embodiments, a signal interconnect comprising thermally resistive, electrically conductive material that provides high thermal isolation and low signal loss, for electrically connecting the micro-strip feed network to the device to be cooled.

The various elements of the apparatus are preferably impedance matched, and the micro-strip feed provided with an impedance matching or conversion portion for matching the impedance of the device to be cooled with the rest of the system, in order to further enhance the thermal isolation properties of differently designed impedance systems available from smaller cross-sectional interconnection components. While such impedance matching is not necessary from an operational standpoint, such impedance matching is preferred. For further information concerning microstrip impedance matching, reference is made to Chapter 5 "Impedance Transformation and Matching", Pages 203–258 of *Foundations For Microwave Engineering* by Robert E. Collins, published by McGraw-Hill, Inc. of New York, N.Y., Copyright 1966, Library of Congress Catalog Card Number 65-21572.

One advantage that may be achieved by embodiments of the present invention in addition to minimizing heat transfer losses is an increase in vacuum life by the elimination of potential virtual leaks and outgassing from organic compounds. The utilization of a crystalline or ceramic support structure and other inorganic materials is consistent with long-life vacuum dewar applications.

Another advantage that may be achieved by embodiments of the present invention is the elimination of threaded fasteners normally found in traditional coaxial applications. Elimination of threaded fasteners and connector backshells further removes the likelihood of virtual leaks from trapped gasses.

BRIEF DESCRIPTION OF THE DRAWINGS

For a fuller understanding of the nature, objects and advantages of the invention, reference should be made to the following detailed description of the invention to be read in connection with the accompanying drawings, in which:

FIG. 2 is a top planar view of a portion of the spiral antenna package of FIG. 1 with a large portion of the cover top removed;

FIG. 3 is a horizontal planar view of the spiral antenna package of FIG. 1 with a portion of the cover side removed to better illustrate the internal components therein and encircled portions labeled "5" and "6" illustrate the location of the enlarged views of FIGS. 5 and 6;

DETAILED DESCRIPTION OF THE PREFERRED EMBODIMENTS

Figure 1:
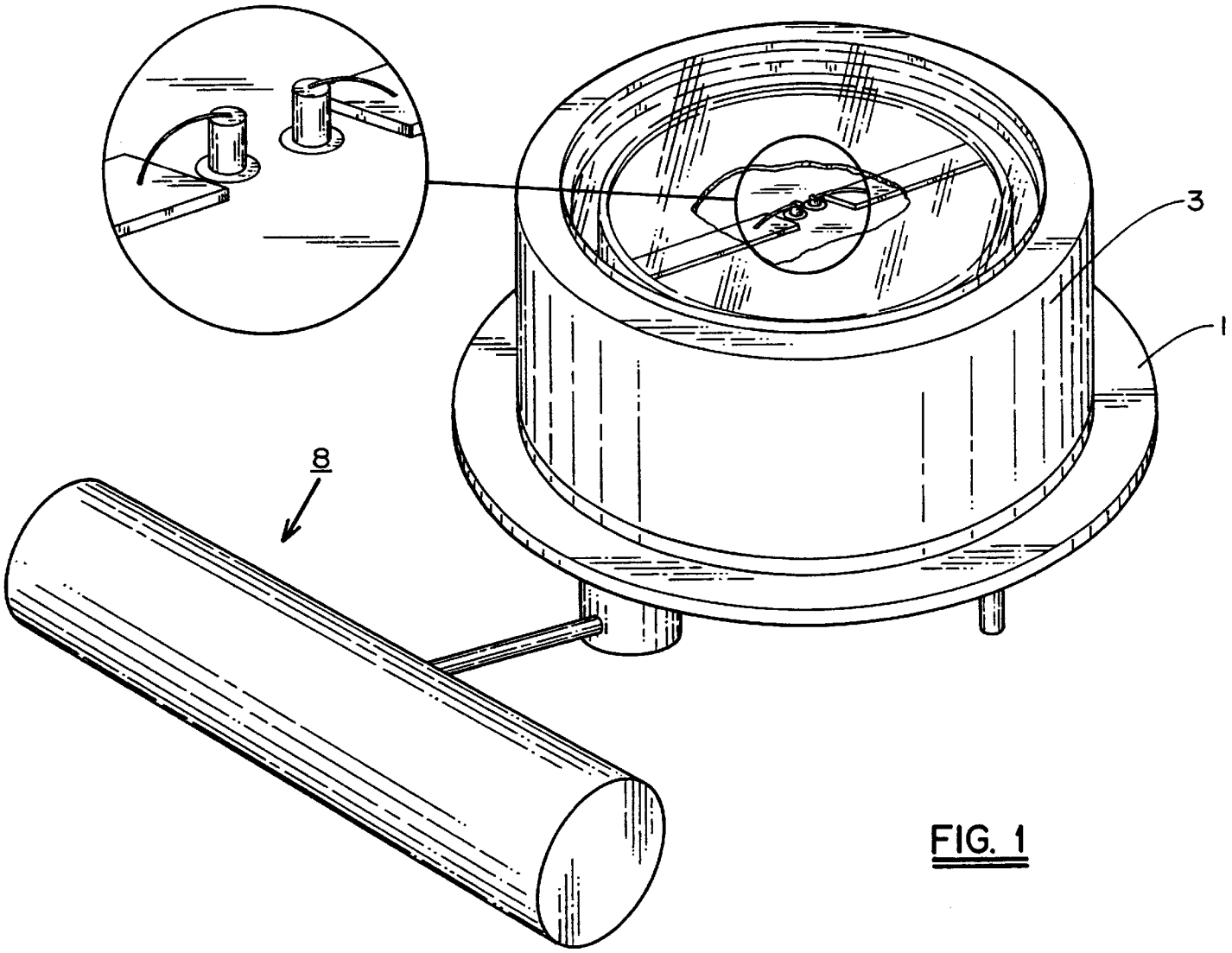
FIG. 1 is a perspective view of a spiral antenna package utilizing one embodiment of the invention, with a circled portion thereof enlarged to better illustrate components thereof.

To better illustrate the invention in use, FIGS. 1–6 show one preferred embodiment of the invention used in a spiral antenna package. A spiral antenna element 5, cooled by a cold finger 7 as seen in FIGS. 2, 3, is enclosed in a dewar comprising a base flange 1 and a cover 3 as seen in FIGS. 1–3 having a window 3*a* (see FIG. 2) through which RF signals are received. The cold finger 7 is operatively connected to a cryocooler 8 (see FIGS. 1–3) in a manner known to those skilled in the art. The signal conduit apparatus of the invention carries RF signals from the antenna element 5 through the flange 1 so that the signal may be accessed.

Figure 5:
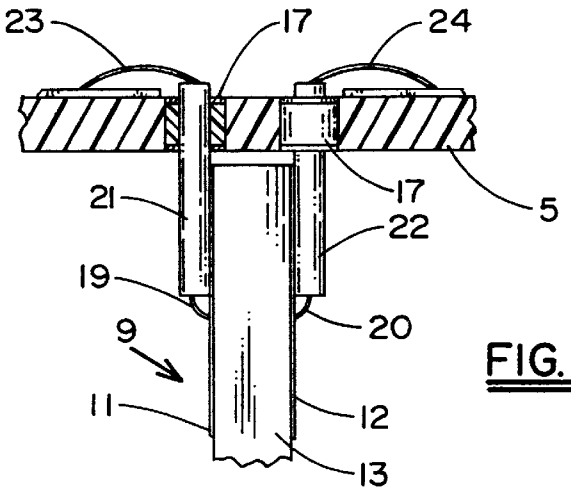
FIG. 5 is an enlarged profile view of one end of the signal conduit interconnect feed of the apparatus illustrated in FIG. 4.
Figure 6:
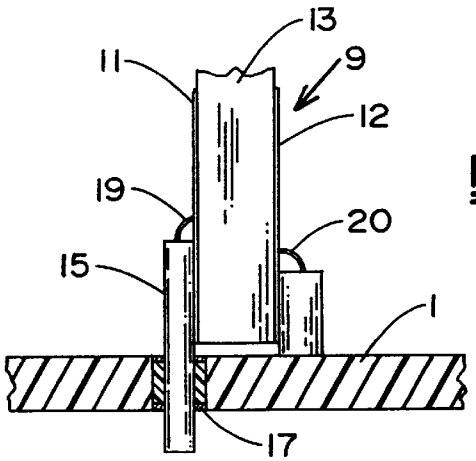
FIG. 6 is an enlarged profile view of the opposite end of the signal conduit interconnect feed of the apparatus illustrated in FIG. 4.
Figure 4:
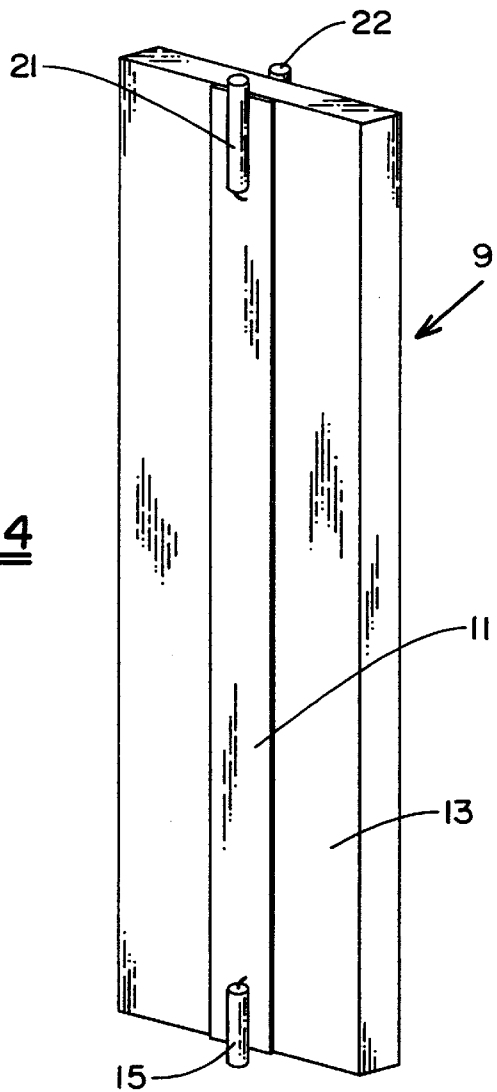
FIG. 4 is an enlarged perspective view of one embodiment of a signal conduit interconnect apparatus constructed in accordance with the invention.

As seen most clearly in FIGS. 4–6, the RF signal received by the spiral antenna element 5 is enclosed in a dewar wherein the temperature of the antenna element is approximately 300K. In order to access the signal for further processing with a minimal signal loss, the signal is coupled to a micro-strip feed 9 which connects the signal and its ground from the antenna 5 for further processing. To this end the micro-strip feed 9 is coupled to the antenna element 5 through a thermally isolated connection best shown in FIG. 5.

In order to thermally isolate the electrical connection between the micro-strip feed 9 and the antenna element 5, a thermally resistive, electrically conductive signal interconnect, wires 23, 24 (see FIG. 5) respectively, couple connector pins 21, 22 (see FIGS. 4, 5) with appropriate portions of spiral antenna element 5 to facilitate further processing of the electrical signal. While wires 23, 24 are preferred as the thermally resistive, electrically conductive interconnect, it is to be understood that conductive ribbons could be utilized, and that the wires 23, 24 can be single or multiple strand. Micro-strip feeds 11, 12 are electrically connected, respectively, to connector pins 21, 22 at solder joints 19, 20 (see FIGS. 5, 6). The signal feed 11 and ground feed 12 are fabricated onto a dielectric material 13 consistent with long vacuum life applications, such as a ceramic or other crystalline material. The thermally resistive, electrically conductive signal interconnect wires 23, 24 are preferably constructed of thermally resistive, electrically conductive material such as a small gauge phosphor/bronze wire of a diameter not to exceed 0.0015 inches and of a length not to exceed 0.1 inch in order to provide high thermal isolation and low signal loss. However, the diameter of the interconnect wires 23, 24 and their length can vary for a particular application. The connector pins 21, 22 are made from copper or any other such electrically conductive material. As described previously, it is preferable that the micro-strip feed be impedance matched, although impedance matching is not necessary for practicing the invention.

Micro-strip signal feed 11 is electrically connected by solder joint 14 (see FIGS. 13, 14) to a vacuum vessel signal penetration member 15 (see FIGS. 4, 6) that penetrates the dewar through an electrically isolated opening 17 in the flange 1. Grounding micro-strip feed 12 is soldered to the flange 1 as best seen in FIG. 6 for grounding.

Figure 7:
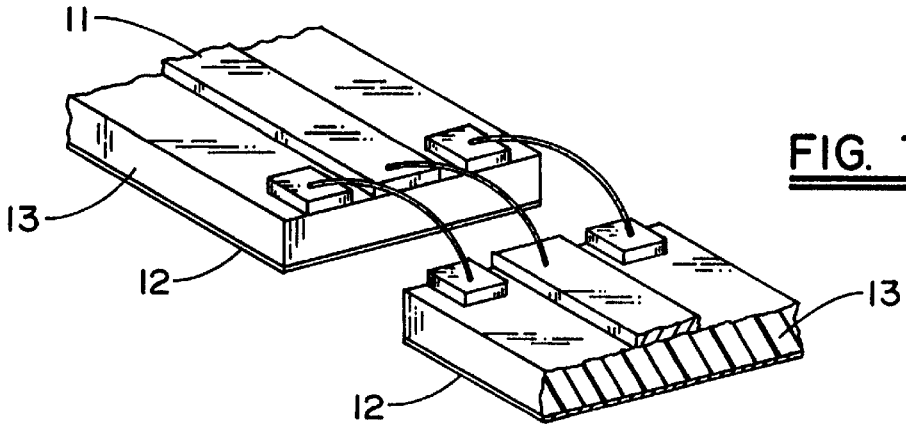
FIG. 7 is a partial perspective view of another embodiment of a micro-strip interconnect feed utilizing a thermally resistive, electrically conductive signal interconnect and a top-side ground and feed.
Figure 8:
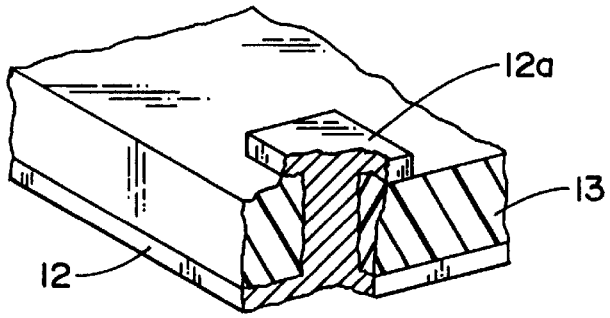
FIG. 8 is an enlarged view of a portion of FIG. 7 broken away to better illustrate the manner in which the ground is provided on the top side of the dielectric.

Referring now to the alternative embodiments as illustrated in FIGS. 7 & 8, FIGS. 9 & 10 and FIGS. 11 & 12, the same substrate 13 is utilized in these embodiments. In these embodiments the signal is carried by the micro-strip feed 11, and a thermally resistive, electrically conductive signal interconnect is utilized to thermally isolate the components as previously described. In the embodiment of FIGS. 7 & 8, the ground 12 is brought to the same side as the signal trace 11 by providing a hole through the dielectric substrate 13 and forming a coupling pad 12*a* on the opposed surface, as best shown in FIG. 8. In this manner when the thermal transition is made, both the signal being fed and the device being cooled will have all connections on the same side of the dielectric material 13 which will facilitate assembly in situations where only the top side of the device is accessible.

Figure 9:
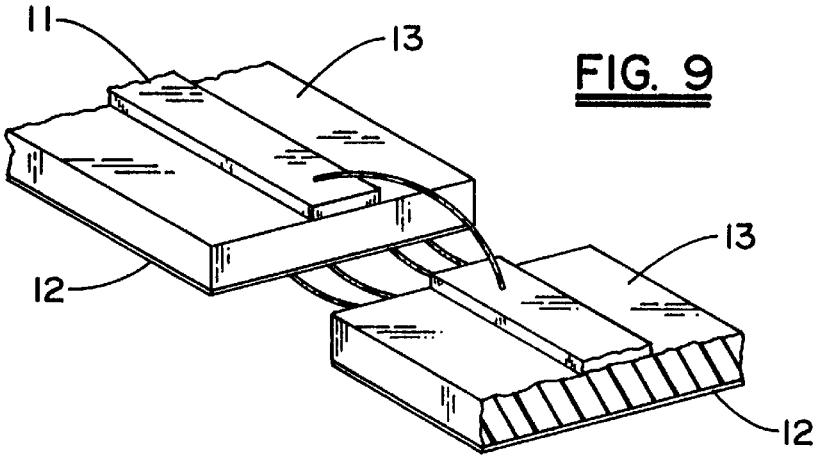
FIG. 9 is a partial perspective view of another embodiment of a micro-strip feed interconnect utilizing a thermally resistive, electrically conductive signal interconnect and a top-side feed with a bottom-side ground.
Figure 10:
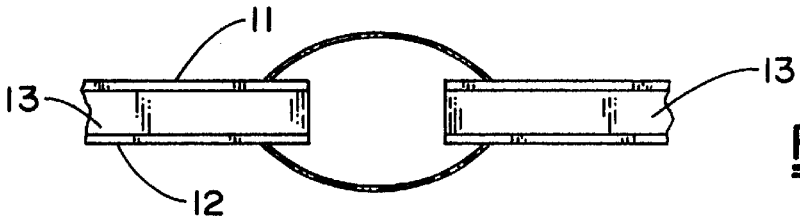
FIG. 10 is a vertical planar view of the micro-strip interconnect of FIG. 9.

The embodiment illustrated in FIGS. 9 & 10, is similar to the embodiment illustrated in FIGS. 1–6 in that the signal trace 11 and ground 12 are positioned on opposed sides of the dielectric material 13, and the two portions of the device are coupled by means of a thermally resistive, electrically conductive signal interconnect.

Figure 11:
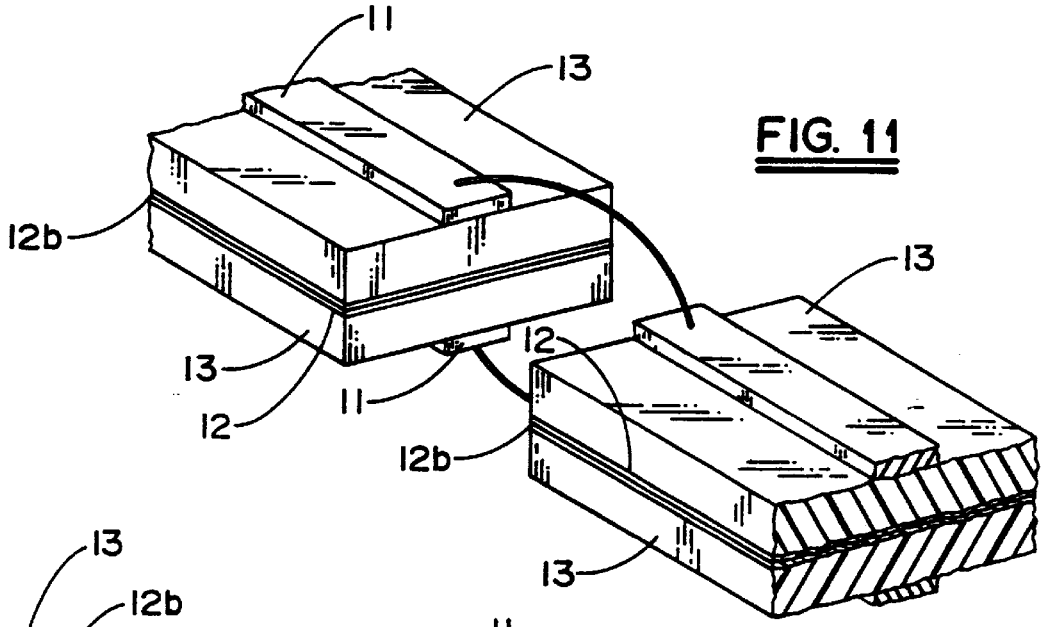
FIG. 11 is a partial perspective view of another embodiment of a micro-strip interconnect utilizing a thermally resistive, electrically conductive signal interconnect with the chassis grounds in contiguous contact, and the signal and signal ground isolated by the dielectric substrate.
Figure 12:
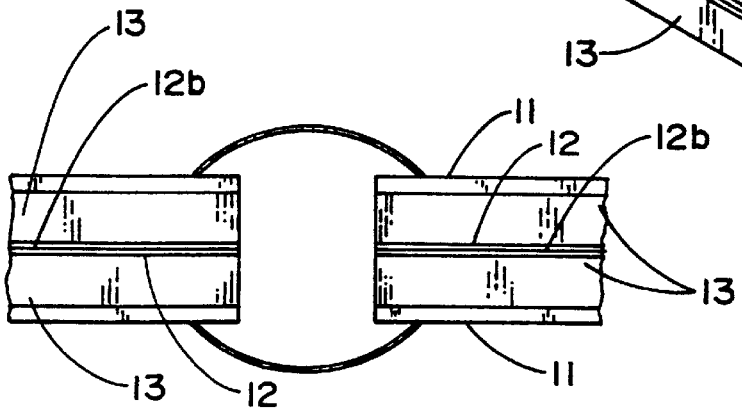
FIG. 12 is a vertical planar view of the micro-strip interconnect of FIG. 11.

In FIGS. 11 & 12, there is illustrated an embodiment to be utilized in applications where the signal ground 12*b*, because of interference "noise" problems or other functional requirements, is preferably isolated from the chassis ground 12 of the system. In such applications, two assemblies are assembled with their chassis grounds contiguous, and a signal ground 12*b* is coupled to the dewar through a feed-through pin such as described with reference to the signal trace illustrated in the embodiment of FIGS. 1–6.

Figure 13:
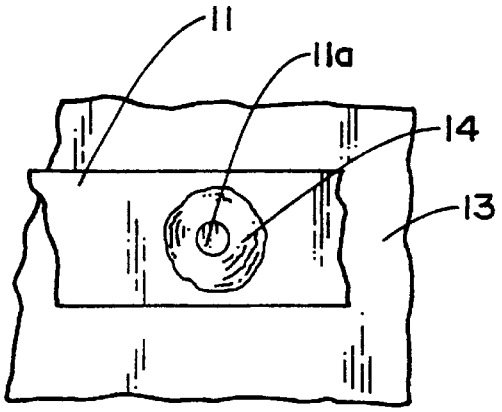
FIG. 13 is a horizontal planar view of yet another embodiment of the invention wherein the micro-strip interconnect utilizes a pin soldered to the micro-strip feed to form a connection with a dewar flange.
Figure 14:
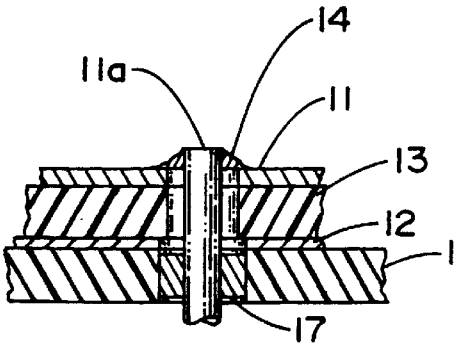
FIG. 14 is a cross sectional view of the embodiment illustrated in FIG. 13, taken along lines 14—14 to better illustrate the manner in which the connection is constructed.

The embodiment of FIGS. 13 & 14 illustrates the micro-strip feed 11 coupled to a pin 11*a* by means of a solder connection 14. In this manner the pin 11*a* passes through concentric openings in the dielectric material 13, and the signal ground 12, and is electrically isolated therefrom. The signal ground 12 (see FIG. 14) is electrically connected to the chassis ground through the flange 1 (see FIG. 14), and the signal pin 11*a,* through which the signal is accessed, is electrically isolated from the flange 1 when passing there-through by means of the electrically isolated opening 17 (see FIG. 14) formed therein.

While the present invention has been particularly shown and described with reference to the preferred mode and alternative embodiments as illustrated in the drawings, it will be understood by one skilled in the art that various changes in detail may be effected therein without departing from the spirit and scope of the invention as defined by the claims.

What is claimed is:

1. A signal conduit apparatus for carrying an electrical signal received at a first location having a first temperature, to a second location having a second temperature different from said first temperature with a minimal signal conduit heat transfer loss comprising:

a dielectric support structure positioned in said second location;

said dielectric support structure supporting a micro-strip signal feed and an electrical ground feed;

a first thermally resistive, electrically conductive signal interconnect electrically connected to said micro-strip signal feed, and a second thermally resistive, electrically conductive signal interconnect electrically connected to said micro-strip electrical ground feed;

said first and second thermally resistive, electrically conductive signal interconnects extending, respectively, from said micro-strip signal feed and said micro-strip electrical ground feed at said second location to said first location for coupling said electrical signal received at said first location to said second location for further processing with a minimal amount of heat transfer.

2. The signal conduit apparatus of claim 1 further including an electrically conductive signal penetration member electrically connected to said micro-strip signal feed carried by said dielectric support structure for coupling said electrical signal for further processing.

3. The signal conduit apparatus of claim 1 further including a vacuum dewar vessel, and said dielectric support structure, said micro-strip signal feed and said electrical ground feed supported thereon are contained within said dewar vessel.

4. The signal conduit apparatus of claim 3 wherein said first and second thermally resistive, electrically conductive signal interconnects are electrically coupled, respectively, to a pin soldered to said micro-strip signal feed and said electrical ground feed at a portion of said pin extending into said dewar vessel.

5. The signal conduit apparatus of claim 1 wherein said first and second thermally resistive, electrically conductive signal interconnects are electrically coupled, respectively, to a pin soldered to said micro-strip signal feed and said electrical ground feed.

6. The signal conduit apparatus of claim 1 wherein said micro-strip signal feed and said electrical ground feed are, respectively, supported on opposed sides of said dielectric support structure.

7. The signal conduit apparatus of claim 6 further including a second dielectric support structure that has structural integrity in vacuum conditions positioned at said first location, said second dielectric support structure having a micro-strip signal feed and an electrical ground feed supported on said second dielectric support structure on opposed sides thereof, said electric ground feed supported on said dielectric support structure being in contact with said electric ground feed supported on said second dielectric support structure to provide a common ground for said respective micro-strip signal feeds supported on said dielectric support structure and said second dielectric support structure.

8. The signal conduit apparatus of claim 1 wherein said micro-strip signal feed and said electrical ground feed are, respectively, supported on a common side of said dielectric support structure.

9. The signal conduit apparatus of claim 1 wherein said first location has a pressure equal to a vacuum or a partial vacuum, and said second location has a pressure different from the pressure at said first location, and said dielectric support structure is comprised of a material that has structural integrity in vacuum conditions.

10. An electrical signal processor for processing an electrical signal received at a first location having a first temperature and a first pressure equal to a vacuum, or a partial vacuum, and said electrical signal processor coupling said received electrical signal to a second location remote from said first location and having a second temperature different from said first temperature and a pressure different from said first pressure comprising:

a signal receiving antenna carried within a vacuum dewar at said first location having a first temperature and a first pressure equal to a vacuum, or a partial vacuum;

a signal conduit including a crystalline dielectric support structure that has structural integrity in vacuum conditions carried within said vacuum dewar and coupled to said signal receiving antenna, and a micro-strip signal feed and an electrical ground feed carried within said vacuum dewar;

said micro-strip signal feed and an electrical ground feed supported on said dielectric support structure;

a first thermally resistive, electrically conductive signal interconnect electrically connected to said micro-strip signal feed, and a second thermally resistive, electrically conductive signal interconnect electrically connected to said micro-strip electrical ground feed;

said first and second thermally resistive, electrically conductive signal interconnects extending, respectively, from said micro-strip signal feed and said micro-strip electrical ground feed carried within said vacuum dewar for coupling said electrical signal received by the antenna at said first location to said second location for further processing with a minimal amount of heat transfer, electrically conductive signal penetration means electrically connected to said micro-strip signal feed and passing from said vacuum dewar to said second location for accessing said signal by a device to which said signal is to be provided.

11. The electrical signal processor of claim 10 wherein said thermally resistive, electrically conductive signal interconnect electrically connected to said micro-strip signal feed, and said thermally resistive, electrically conductive signal interconnect electrically connected to said micro-strip electrical ground feed are electrically connected to said antenna by an air-gap connection.

12. The signal conduit apparatus of claim 10 wherein said micro-strip signal feed and said electrical ground feed are, respectively, supported on opposed sides of said dielectric support structure.

13. The signal conduit apparatus of claim 12 further including a second dielectric support structure that has structural integrity in vacuum conditions positioned in said vacuum dewar, said second dielectric support structure having a second micro-strip signal feed and a second electrical ground feed supported on said second dielectric support structure on opposed sides thereof, said electric ground feed supported of said dielectric support structure being in contact with said second electric ground feed supported on said second dielectric support structure to form a common ground for said micro-strip signal feeds supported on both of said dielectric support structures.

14. The signal conduit apparatus of claim 10 wherein said micro-strip signal feed and said electrical ground feed are, respectively, supported on a common side of said dielectric support structure.

* * * * *